US006422807B1

(12) United States Patent
Leach et al.

(10) Patent No.: US 6,422,807 B1
(45) Date of Patent: Jul. 23, 2002

(54) TURBINE INNER SHELL HEATING AND COOLING FLOW CIRCUIT

(75) Inventors: David Leach, Niskayuna; Iain Robertson Kellock, Clifton Park, both of NY (US); Larry Wayne Plemmons, deceased, late of Hamilton, OH (US), by Helen M Plemmons, executrix; Cedric Chow, Schenectady; Brendan Francis Sexton, Clifton Park, both of NY (US); Mark Stewart Schroder, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/726,213

(22) Filed: Nov. 28, 2000

Related U.S. Application Data

(63) Continuation of application No. 09/298,400, filed on Apr. 23, 1999, now abandoned.

(51) Int. Cl.[7] ..... F01D 11/24

(52) U.S. Cl. ..... 415/1; 415/136; 415/173.2; 415/175; 415/176; 415/178

(58) Field of Search ..... 415/1, 136, 139, 415/173.1, 173.2, 173.3, 175, 176, 177, 178

(56) References Cited

U.S. PATENT DOCUMENTS 4,525,998 A 7/1985 Schwarz
5,605,437 A 2/1997 Meylan
5,667,358 A 9/1997 Gaul
5,685,693 A 11/1997 Sexton et al.
5,967,743 A 10/1999 Meylan

OTHER PUBLICATIONS

"39th GE Turbine State–of–the–Art Technology Seminar", Tab 1, ""F"Technology—the First Half–Million Operating Hours", H.E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

(List continued on next page.)

*Primary Examiner*—Christopher Verdier
(74) *Attorney, Agent, or Firm*—Nixon & Vanderhye

(57) ABSTRACT

A method of operating a gas turbine having inner and outer shells, with the inner shell being radially movable relative to rotor bucket tip passage in the inner shell for flowing a thermal medium. A pair of passage portions are formed in each of the aft and forward inner shell sections with axially communicating passageways between the passage portions. A thermal medium, preferably from an off-turbine site, is provided for flow through the second-stage aft inner shell section, along axial passageways along the mid-line of the inner shell to a first passage portion of the forward inner shell section. Cross-over paths flow the thermal medium from the first passage portions to second circumferentially extending passage portions of the forward inner shell section, in turn, in communication with axial passageways extending from the forward section to the aft section. A second pair of passage portions flow the thermal medium to an outlet in the aft section. By controlling the temperature of the thermal medium for flow through the aft and forward sections of the inner shell, the clearance between the shrouds and the tips of the buckets for at least the first and second stages of the turbine is controllably adjusted.

12 Claims, 4 Drawing Sheets

OTHER PUBLICATIONS

"39th GE Turbine State–of–the–Art Technology Seminar", Tab 3, "9EC 50Hz 170–MW Class Gas Turbine", A. S. Arrao, Aug. 1996.
"39th GE Turbine State–of–the–Art Technology Seminar", Tab 4, "MWS6001FA—An Advanced–Technology 70–MW Class 50/60 Hz Gas Turbine", Ramachandran et al., Aug. 1996.
"39th GE Turbine State–of–the–Art Technology Seminar", Tab 5, "Turbomachinery Technology Advances at Nuovo Pignone", Benevenuti et al., Aug. 1996.
"39th GE Turbine State–of–the–Art Technology Seminar", Tab 6, "GE Aeroderivative Gas Turbines—Design and Operating Features", M.W. Horner, Aug. 1996.
"39th GE Turbine State–of–the–Art Technology Seminar", Tab 7, "Advance Gas Turbine Materials and Coatings", P.W. Schilke, Aug. 1996.
"39th GE Turbine State–of–the–Art Technology Seminar", Tab 8, "Dry Low $NO_x$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combines Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, "J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics" Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive System Turbines", D. R. Leger, Aug. 1996.
"39th GE Turbine State–of–the–Art Technology Seminar", Tab 25, "Steam Turbines for STAG ™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density ™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines"D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind ", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2—Indusrial Machine, Mar. 31, 1997, Morgantown, WV.
"Advanced Turbine Systems (ATS Program), Conceptual Design and Product Development", Final Technical Progress Report, Aug. 31, 1996, Morgantown , WV.
"Advanced Turbine Systems (ATS) Program, Phase 2, Conceptual Design and Product Development", Yearly Technical Progress Report, Reporting Period: Aug. 25, 1993–Aug. 31, 1994.

"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systmes Gas Turbine Manufacturing Facility, Greenville SC", Document #1753, Feb. 1998, Publication Date: Nov. 17, 1998, Report Nos. DE–FC21–95MC31176—11.
"Exhibit panels used at 1995 product introduction at PowerGen Europe".
"Extensive Testing Program Validates High Efficiency, reliability of GE's Advanced "H"Gas Turbine Technology", Press Information, Press Release, 96–NR14, Jun. 26, 1996, H Technology Tests/pp. 1–4.
"Extensive Testing Program Validates High Effieciency", "Reliability of GE's Advanced Gas Turbine Turbine Technology Platform: First to Reach 60% Combined–Cycle Power Plant Efficiency", Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar. 1998.
"H Technology", Jon Ebacher, VP, Power Gen Technology, May 8, 1998.
"H Testing Process", Jon Ebacher, VP Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995, to Dec. 31, 1997.
"Power Systems for the 21st Century—"H" Gas Turbine Combined Cycles", Thomas C. Paul et al., Report,.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, pp. 3–13, Oct., 1995.
"Proceedings of the Advanced Turbine Systems Annual Program Review Meeting", vol. I, "H Gas Turbine Combined Cycle", J. Corman, pp. 14–21, Oct., 1995.
"Proceedings of the Advanced Turbine Systems Annual Program Review Meeting", vol. I, "Overview of Westinghouse's Advanced Turbine Systems Program", Bannister et al., pp. 22–30, Oct., 1995.
"Proceedings of the Advanced Turbine Systems Annual Program Review Meeting", vol. I, "Allison Engine ATS Program Technical Review", D. Mukavetz, pp. 31–42, Oct., 1995.
"Proceedings of the Advanced Turbine Systems Annual Program Review Meeting", vol. I, "Advanced Turbine Systems Program Industrial System Concept Development", S. Gates, pp. 43–63, Oct., 1995.
"Proceedings of the Advanced Turbine Systems Annual Program Review Meeting", vol. I, "Advanced Turbine System Program Phase 2 Cycle Selection", Latcovich, Jr., pp. 64–69, Oct., 1995.
"Proceedings of the Advanced Turbine Systems Annual Program Review Meeting", vol. I, "General Electric ATS Program Technical Review Phase 2 Activities", Chance et al., pp. 70–74, Oct., 1995.
"Proceedings of the Advanced Turbine Systems Annual Program Review Meeting", vol. I, "Technical Review of Westinghouse's Advanced Turbine Systems Program", Diakunchak et al., pp. 75–86, Oct., 1995.
"Proceedings of the Advanced Turbine Systems Annual Program Review Meeting", vol. I, "Advanced Combustion Turbines and Cycles: An EPRI Perspective", Touchton et al., pp. 87–88, Oct., 1995.
"Proceedings of the Advanced Turbine Systems Annual Program Review Meeting", vol. I, "Advanced Turbine Systems Annual Program Review", William E. Koop, pp. 89–92, Oct. 1995.
"Proceedings of the Advanced Turbine Systems Annual Program Review Meeting", vol. I, "The AGTSR Consortium: An Update", Fant et al., pp. 93–102, Oct. 1995.
"Proceedings of the Advanced Turbine Systems Annual Program Review Meeting", vol. I, "Overview of Allison/AGTSR Interactions", Sy A. Ali, pp. 103–106, Oct., 1995.
"Proceedings of the Advanced Turbine Systems Annual Program Review Meeting", vol. I, "Design Factors for Stable Lean Premix Combustion", Richards et al., pp. 107–113, Oct., 1995.
"Proceedings of the Advanced Turbine Systems Annual Program Review Meeting", vol. I, "Ceramic Stationary as Turbine", M. van Roode, pp. 114–147, Oct., 1995.
"Proceedings of the Advanced Turbine Systems Annual Program Review Meeting", vol. I, "DOE/Allison Ceramic Vane Effort", Wenglarz et al., pp. 148–151, Oct., 1995.
"Proceedings of the Advanced Turbine Systems Annual Program Review Meeting", vol. I, "Materials/Manufacturing Element of the Advanced Turbine Systems Program", Karnitz et al., pp. 152–160, Oct., 1995.
"Proceedings of the Advanced Turbine Systems Annual Program Review Meeting", vol. I, "Land–Based Turbine Casting Initiative", Mueller et al., pp. 161–170, Oct., 1995.

"Proceedings of the Advanced Turbine Systems Annual Program Review Meeting", vol. I, "Turbine Airfoil Manufacturing Technology ", Kortovich, pp. 161–170, Oct., 1995.

"Proceedings of the Advanced Turbine Systems Annual Program Review Meeting", vol. I, "Pratt & Whitney Thermal Barrier Coatings", Bornstein et al., pp. 182–193, Oct., 1995.

"Proceedings of the Advanced Turbine Systems Annual Program Review Meeting", vol. I, "Westinhouse Thermal Barrier Coatings", Goedjen et al., pp. 194–199, Oct., 1995.

"Proceedings of the Advanced Turbine Systems Annual Program Review Meeting", vol. I, "High Performance Steam Development", Duffy et al., pp. 200–220, Oct., 1995.

"Proceedings of the Advanced Turbine Systems Annual Program Review Meeting", vol. II, "Lean–Premixed Combustion Stabilized by Radiation Feedback and heterogeneous Catalysis", Dibble et al., pp. 221–232, Oct., 1995.

"Proceedings of the Advanced Turbine Systems Annual Program Review Meeting", vol. II, "Rayleigh/Raman/LIF Measurements in a Turbulent Lean Premixed Combustor", Nandula et al. pp. 233–248, Oct., 1995.

"Proceedings of the Advanced Turbine Systems Annual Program Review Meeting", vol. II, "Lean Premixed Flames for Low $No_x$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting", vol. II, "The Role of Reactant Unmixedness, Strain Rate, and Length Scale on Premixed Combustor Performance", Samuelsen et al., pp. 415–422, Oct., 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatability of Gas Turbine Materials with Steam Cooling", Desai et al., pp. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, pp. 465–473, Oct., 1995.

"Proceedings of the Advanced Turbine Systems Annual Program Review Meeting", vol. II, "Effects of Geometry on Slot–Jet Film Cooling Performance", Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., pp. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esbeck, pp. 27–34, Nov., 1996.

"Proceedings of the Advanced Turbine Systems Annual Program Review Meeting", "Westinghouse's Advanced Turbine Systems Program", Gerard McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.

"Proceedings of the Advanced Turbine Systems Annual Program Review Meeting", "Allison Advanced Simple Cycle Gas Turbine System", William D. Weisbrod, pp. 73–94, Nov., 1996.

"Proceedings of the Advanced Turbine Systems Annual Program Review Meeting", "The AGTSR Industry–University Consortium", Lawrence P. Golan, pp. 95–110, Nov., 1996.

"Proceedings of the Advanced Turbine Systems Annual Program Review Meeting", "$NO_x$ and CO Emissions Models for Gas–Fired Lean–Premixed Combustion Turbines", A. Mellor, pp. 111–122, Nov., 1996.

"Proceedings of the Advanced Turbine Systems Annual Program Review Meeting", "Methodologies for Active Mixing and Combustion Control", Uri Vandsburger, pp. 123–156, Nov., 1996.

"Proceedings of the Advanced Turbine Systems Annual Program Review Meeting", "Combustion Modeling in Advanced Gas Turbine Systems", Paul O. Hedman, pp. 157–180, Nov., 19967.

"Proceedings of the Advanced Turbine Systems Annual Program Review Meeting", "Manifold Methods for Methane Combustion", Stephen B. Pope, pp. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, pp. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov., 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", "Active Control of Combustion Instabilities in Low $NO_x$ Turbines", Ben T. Zinn, pp. 253–264, Nov., 1996.

"Proceedings of the Advanced Turbine Systems Annual Program Review Meeting", "Life Prediction of Advanced Materials for Gas Turbine Application, " Sam Y. Zamrik, pp. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", "Compatibility of Gas Turbine Materials with Steam Cooling", Vimal Desai, pp. 291–314, Nov., 1996.

"Proceedings of the Advanced Turbine Systems Annual Program Review Meeting", "Bond Strength and Stress Measurements in Thermal Barrier Coatings", Maurice Gell, pp. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.

"Proceedings of the Advanced Turbine Systems Annual Program Review Meeting", "Improved Modeling Techniques for Turbomachinery Flow Fields", B. Lakshiminarayana, pp. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov., 1996.

"Proceedings of the Advanced Turbine Systems Annual Program Review Meeting", "Study of Endwall Film Cooling with a Gap Leakage Using a Thermographic Phosphor Fluoroscence Imaging System", Mingking K. Chyu, pp. 461–470, Nov., 1996.

"Proceedings of the Advanced Turbine Systems Annual Program Review Meeting", "Steam as a Turbine Blade Coolant: External Side Heat Transfer", Abraham Engeda, pp. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.

"Proceedings of the Advanced Turbine Systems Annual Program Review Meeting", "Closed–Loop Mist/Steam Cooling for Advanced Turbine Systems", Ting Wang, pp. 499–512, Nov., 1996.
"Proceedings of the Advanced Turbine Systems Annual Program Review Meeting", "Heat Pipe Turbine Vane Cooling", Langston et al., pp. 513–534, Nov., 1996.
"Proceedings of the Advanced Turbine Systems Annual Program Review Meeting", "EPRI's Combustion Turbine Program: Status and Future Directions", Arthur Cohn, pp. 535,–552 Nov., 1996.
"Proceedings of the Advanced Turbine Systems Annual Program Review Meeting", "ATS Materials Support", Michael Karnitz, pp. 553–576, Nov., 1996.
"Proceedings of the Advanced Turbine Systems Annual Program Review Meeting", "Land Based Turbine Casting Initiative", Boyd A. Mueller, pp. 577–592, Nov., 1996.
"Proceedings of the Advanced Turbine Systems Annual Program Review Meeting", "Turbine Airfoil Manufacturing Technology", Charles S. Kortovich, pp. 593–622, Nov., 1996.
"Proceedings of the Advanced Turbine Systems Annual Program Review Meeting", "Hot Corrosion Testing of TBS's", Norman Bornstein, pp. 623–631, Nov., 1996.
"Proceedings of the Advanced Turbine Systems Annual Program Review Meeting", "Ceramic Stationary Gas Turbine", Mark van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available),.
"Testing Program Results Validate GE's H Gas Turbine–High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos. DOE/MC/31176—5628,.
"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176—10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Nos. DOE/MC/31176—5340.
"Utility Advanced Turbine System (ATS) Technology Readiness Testing and Pre–Commercial Demonstration—Phase 3", Document #486132, Apr. 1–Jun. 30, 1976, Publication Date, Dec. 31, 1996, Report Nos. DOE/MC/31176—5660.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.: DOE/MC/31179—8.
"Utility Advanced Turbine System (ATS) Technology Readiness Testing and Pre–Commercialization Demonstration" Jan. 1–Mar. 31, 1996, DOE/MC/31176—5338.
"Utility Advanced Turbine System (ATS) Technology Readiness Testing: Phase 3R", Document #756552, Apr. 1–Jun. 30, 1999, Publication Date, Sep. 1, 1999, Report Nos. DE—FC21–95MC31176–23.
"Utility Advanced Turbine System (ATS) Technology Readiness Testing.", Document #656823, Jan. 1–Mar. 31, 1998, Publication Date, Aug. 1, 1998, Report Nos.: DOE/MC/31176–17.
"Utility Advanced Turbine System (ATS) Technology Readiness Testing.", Document #656823, Jan. 1–Mar. 31, 1998, Publication Date, Aug. 1, 1998, Report Nos.: DOE/MC/31176–17.
"Utility Advanced Turbine Systems (ATS) Technology Readiness Testing", Phase 3R, Annual Technical Progress Report, Reporting Period: Oct. 1, 1997–Sep. 30, 1998.
"Utility Advanced Turbine Systems (ATS) Technology Readiness Testing", Document #750405, Oct. 1–Dec. 30, 1998, Publication Date: May, 1, 1999, Report Nos.: DE–FC21–95MC31176–20.
"Utility Advanced Turbine Systems (ATS) Technology Readiness Testing", Document #1348, Apr. 1–Jun. 29, 1998, Publication Date Oct. 29, 1998, Report Nos. DE–FC21–95MC31176—18.
"Utility Advanced Turbine Systems (ATS) Technology Readiness Testing—Phase 3", Annual Technical Progress Report, Reporting Period: Oct. 1, 1996 –Sep. 30, 1997.
"Utility Advanced Turbine Systems (ATS) Technology Readiness Testing and Pre–Commercial Demonstration", Quarterly Report, Jan. 1–Mar. 31, 1997, Document #666275, Report Nos: DOE/MC/31176–07.
"Proceedings of the 1997 Advanced Turbine Systems", Annual Program Review Meeting, Oct. 28–29, 1997.
"Utility Advanced Turbine System (ATS) Technology Readiness Testing and Pre–Commercial Demonstration—Phase", Document #587906, Jul. 1–Sep. 30, 1995, Publication Date, Dec. 31, 1997, Report Nos.: DOE/MC/31176—5339.

52
34
38
40
36
44
42
28
20
30
22
32
26
12
14
24
16
26
18

Fig. 3
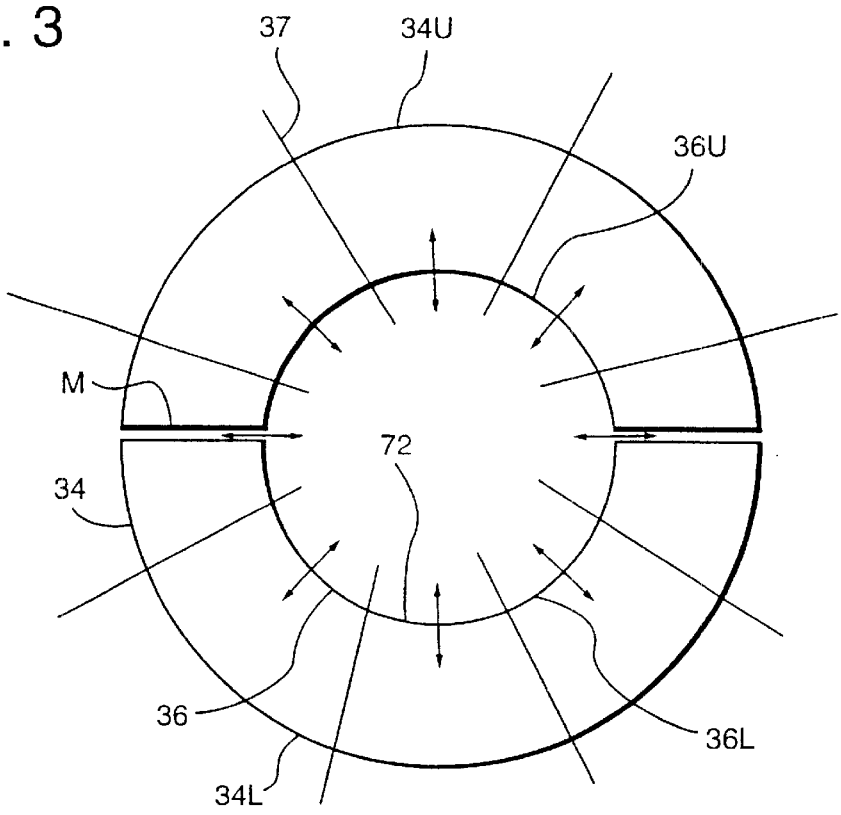
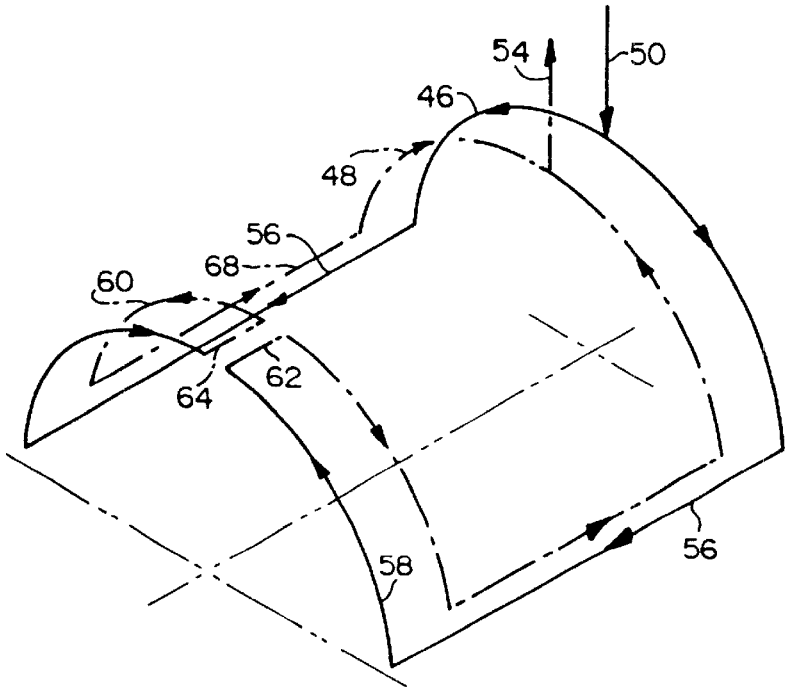
Fig. 5

TURBINE INNER SHELL HEATING AND COOLING FLOW CIRCUIT

This application is a continuation of application Ser. No. 09/298,400, filed Apr. 23, 1999, now abandoned, the entire content of which is hereby incorporated by reference in this application.

TECHNICAL FIELD

The present invention relates generally to gas turbines, particularly to land-based, i.e., industrial gas turbines employing closed-circuit steam or air cooling of hot gas path components and more particularly to a gas turbine having inner and outer turbine shells constructed to provide positive bucket tip clearance control.

BACKGROUND OF THE INVENTION

In prior U.S. Pat. No. 5,685,693, of common assignee herewith, there is disclosed a land-based, i.e., industrial gas turbine having a turbine outer shell surrounding an inner shell supporting non-rotational parts of certain of the stages. Particularly, the inner shell supports the first and second-stage nozzles, as well as the first and second-stage shrouds. The outer shell directly supports the nozzles and shrouds of additional stages. It will be appreciated that each of the inner and outer shells is formed in circumferentially extending sections about the rotor axis, preferably in two circumferential halves (upper and lower) of 180° each. The upper outer shell half and each inner shell half are individually removable from the turbine without removal of the rotor to enable access to the hot gas path components for maintenance and repair. In the above patent, the inner shell is supported by pins extending between the inner and outer shells in a manner preventing circumferential, axial and radial movement of the shells relative to one another while enabling radial expansion and contraction of the inner shell relative to the outer shell for controlling clearance between the shrouds and the bucket tips.

In the above-noted patent, the clearance control system includes a pair of plenums in each of the inner shell halves and which plenums are connected one to the other by a passageway. Particularly, for each inner shell half, the first or forward plenum overlying the first-stage shrouds and bucket tips has an inlet for receiving cooling air, the cooling air flowing circumferentially about the plenum to the mid-line of the inner shell half. Axially extending passages along diametrically opposite mid-lines extend from the forward plenum back to a similar circumferentially extending aft plenum overlying the second-stage shrouds and buckets. An outlet is provided in the aft plenum. Thus, cooling air at steady-state operation from an external air source is supplied to the first-stage plenum inlet for flow about the plenum, axially along the mid-line and about the second-stage plenum to the outlet. It will be appreciated that by flowing a thermal medium in the described thermal circuit, the inner shell may contract and expand in a radial direction in response to flow of the thermal medium. Consequently, by controlling the thermal expansion or contraction in a radial direction of the inner shell relative to the tips of the buckets of the first and second stages, tip clearance control is afforded. With the advent of a further advanced gas turbine design by assignee, there has, however, been demonstrated a need for an enhanced inner shell cooling circuit.

BRIEF SUMMARY OF THE INVENTION

In accordance with a preferred embodiment of the present invention, the advanced gas turbine design includes an inner shell having inner shell halves each having a forward and aft section containing plenums communicating with one another such that a thermal medium may be supplied to one section for flow axially to the other section and return to the one section. Particularly, for each inner shell half, the thermal medium is supplied via an inlet for circumferential flow in a first plenum of the first inner shell half section and for flow generally axially along a first set of passageways in communication with a first plenum of the second section for circumferential flow therein. The first plenum of the second section communicates with a second plenum of the second section whereby the flow reverses direction for flow circumferentially about the second section and then along a second set of axial passageways along the mid-line of the inner shell half to the second plenum of the first section. The flow enters circumferentially extending second passage portions in the second plenum of the first section for exit and return to the thermal medium supply.

Preferably, the thermal medium supply comprises an auxiliary thermal medium source independent of turbine operation whereby the temperature of the thermal medium can be controlled independently of the turbine. By flowing the thermal medium in the described circuit, the inner shell can be expanded at a rate at least equal to or greater than the thermal expansion rate of the rotor and buckets during start-up to prevent contact between the turbine tips and the shrouds and to preclude a rate of contraction of the inner shell less than the rate of contraction of the rotor and buckets to avoid contact between the turbine tips and the shrouds during shutdown. During steady-state operation, the temperature of the thermal medium is controlled to expand or contract the inner shell to minimize the clearance between the shrouds and the bucket tips, affording enhanced turbine efficiency.

In a preferred embodiment according to the present invention, there is provided a method of operating a turbine having a rotor including axially spaced buckets carried thereby forming parts of turbine stages, an outer containment shell, an inner shell about the rotor including nozzles carried thereby forming other parts of the turbine stages, the inner shell including axially spaced sections and shrouds carried by the sections about the respective tips of the buckets of the stages, and a passage formed in the inner shell for flow of a thermal medium to control thermal movement of the inner shell, comprising the steps of forming at least partially circumferentially extending first portions of the passage in the sections of the inner shell substantially at each axial location of the buckets of the respective stages, providing a first passageway in the inner shell connecting the first passage portions to one another, flowing a thermal medium through (i) a first passage portion of one section, (ii) the first passageway and (iii) first passage portion of another section, forming at least partially circumferentially extending second portions of the passage in the sections of the inner shell substantially at each axial location of the buckets of the respective stages, providing a second passageway in the inner shell connecting the second passage portions to one another, connecting the first passage portion of another section with the second passage portion of another section for flowing the thermal medium therebetween and flowing the thermal medium through (i) the second passage portion of another section, (ii) the second passageway and (iii) the second passage portion of one section, thereby controlling the thermal radial expansion and contraction of the inner shell and the clearance between tips of the buckets and shrouds of each stage.

In a further preferred embodiment according to the present invention, there is provided a method of operating a turbine having a rotor including axially spaced buckets carried thereby forming parts of turbine stages, an outer containment shell, an inner shell about the rotor including nozzles carried thereby forming other parts of the turbine stages and shrouds about the respective tips of the buckets of the stages, and a passage formed in the inner shell for flow of a thermal medium to control thermal movement of the inner shell, comprising the steps of flowing a thermal medium serially (i) through passage portions of the inner shell at a first axial location corresponding in part to an axial location of the second stage of said turbine, (ii) forwardly along the inner shell from the first axial location to passage portions of the inner shell at a second location corresponding in part to an axial location of a first stage of the turbine and (iii) rearwardly along the inner shell from the second axial location to passage portions of the inner shell at the first axial locations to control the thermal radial expansion and contraction of the inner shell and the clearance between the tips of the buckets and shrouds of each first and second stages.

BRIEF DESCRIPTION OF THE DRAWINGS

FIG. 3 is a schematic view taken along an axial plane illustrating the location of the pin connections between the inner and outer shells;

FIG. 5 is a schematic illustration of the flow circuit for the inner shell.

DETAILED DESCRIPTION OF THE INVENTION

Figure 1:
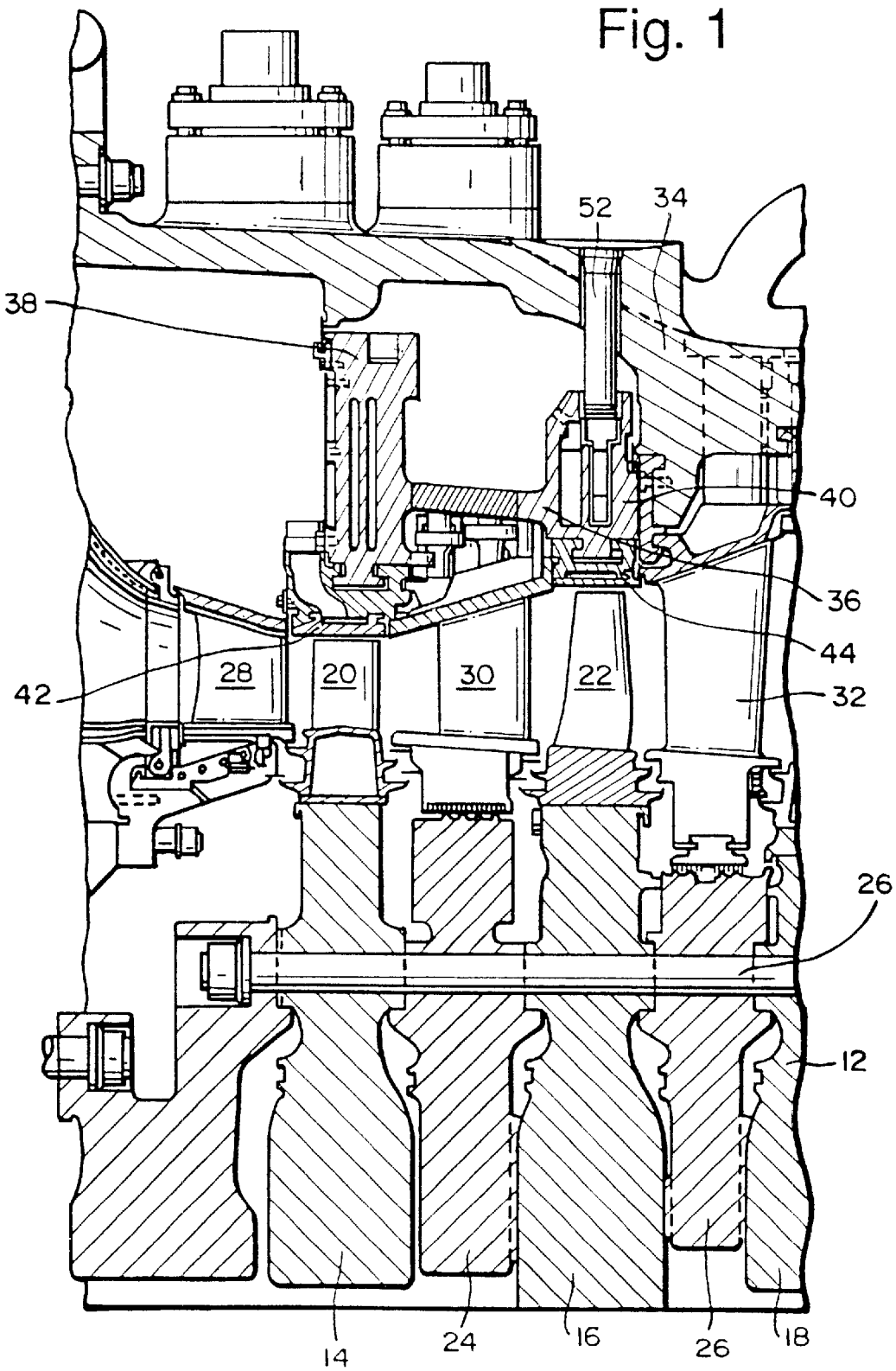
FIG. 1 is a fragmentary cross-sectional view through a portion of a gas turbine illustrating portions of the inner and outer shells.
Figure 2:
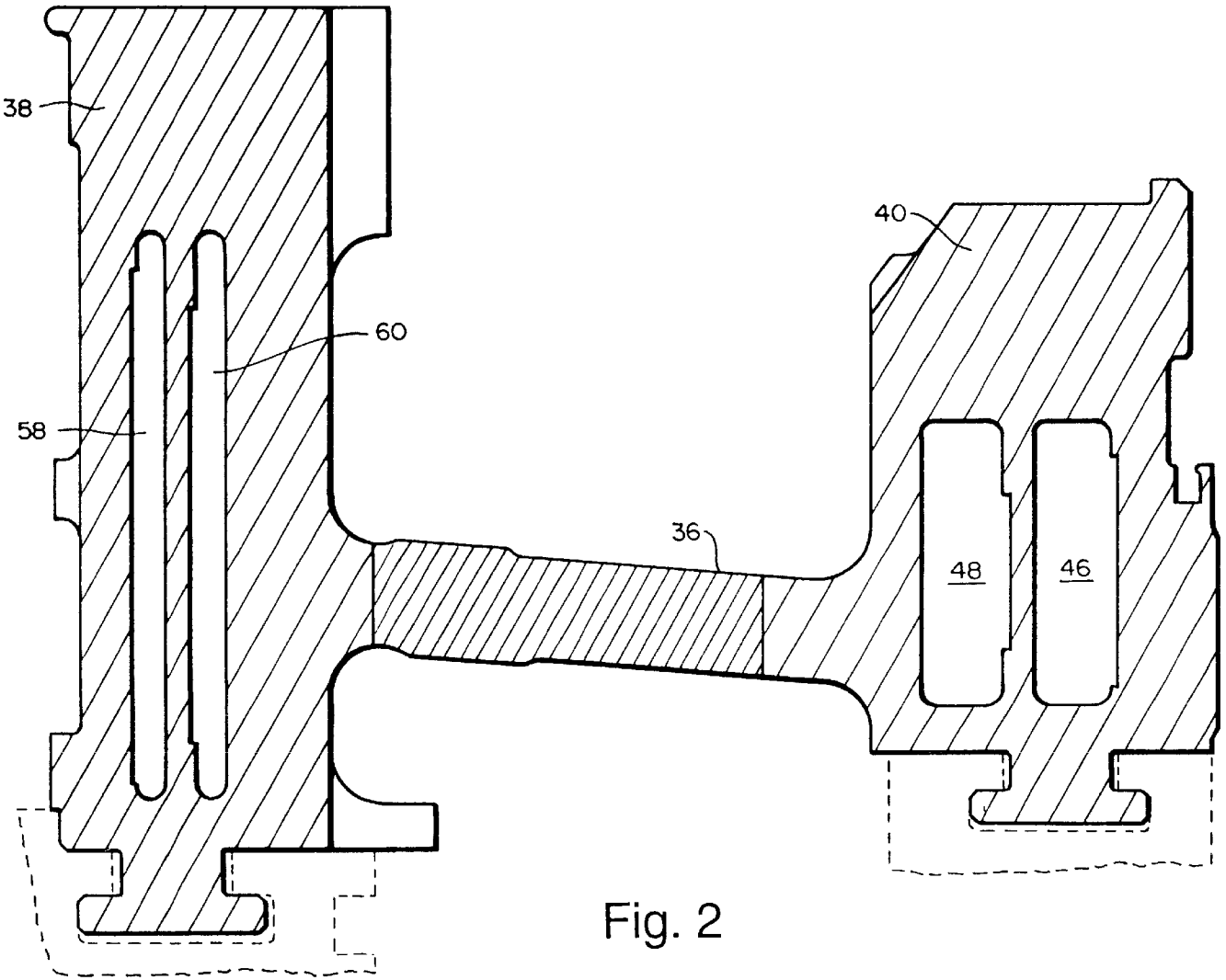
FIG. 2 is an enlarged cross-sectional view of a portion of the inner shell.

Referring now to the drawings, particularly to FIG. 1, there is illustrated a portion of a gas turbine incorporating the present invention. The turbine includes a rotor 12, only a portion of which is illustrated, and which comprises turbine wheels 14, 16 and 18, each carrying a circular array of buckets, the buckets 20 and 22 for wheels 14 and 16 being illustrated. Spacers or disks 24, 26 are interposed between the wheels and the stack-up of wheels and spacers are bolted together by bolts 26 to form the rotor 12. Nozzles are likewise arranged in circumferential arrays, alternating with the buckets of the wheels, nozzles 28, 30 and 32 being illustrated. It will be appreciated that the first stage of the turbine comprises nozzles 28 and buckets 20, the second stage, nozzles 30 and buckets 22, the third stage, nozzles 32 and buckets for wheel 18, and so on, depending upon the number of stages of the gas turbine.

The gas turbine includes an outer structural containment shell 34 and an inner shell 36. Each outer shell and inner shell is formed in semi-circular sections joined along a horizontal mid-line, the upper halves of the outer and inner shells being illustrated. The inner shell 36 includes forward and aft shell sections 38 and 40, respectively, mounted for radial contraction and expansion relative to the outer shell 34 by pins 37. An arrangement of pins for mounting the inner shell and outer shell to one another is described in U.S. Pat. No. 5,685,693, the disclosure of which is incorporated by reference. Suffice to say that the inner shell may expand and contract radially, e.g., in the directions of the arrows of FIG. 3 in a controlled manner relative to the rotor for adjusting the clearance between the shrouds 42 and 44 carried by the forward and aft shells, respectively. Hence, the inner shell is adjustable radially relative to the tips of the buckets of the corresponding stages, i.e., respective buckets 20 and 22. Also, as schematically illustrated in FIG. 3, each of the inner and outer shells is comprised of shell halves extending to a horizontal mid-line M where the upper and lower outer shell halves 34U and 34L are bolted to one another and the upper and lower inner shell halves 36U and 36L are secured to one another.

The aft section 40 includes a pair of axially spaced circumferentially extending first and second passage portions 46 and 48, respectively. A thermal medium inlet 50 (FIG. 4) lies in communication with the plenum or passage portion 46 by way of a hollow spoolie 52 (FIG. 1), in turn in communication with a thermal medium source, described below. It will be appreciated that the first and second passage portions 46 and 48 extend circumferentially about the aft section 40 to adjacent the mid-line of the inner shell half. The inlet 50 preferably is provided medially of the split line for the inner shell half. A spent cooling thermal medium outlet 54 (FIG. 4) lies in communication with the second passage portion 48 of the aft inner shell section 40 for returning spent cooling medium to the external source.

Figure 4:
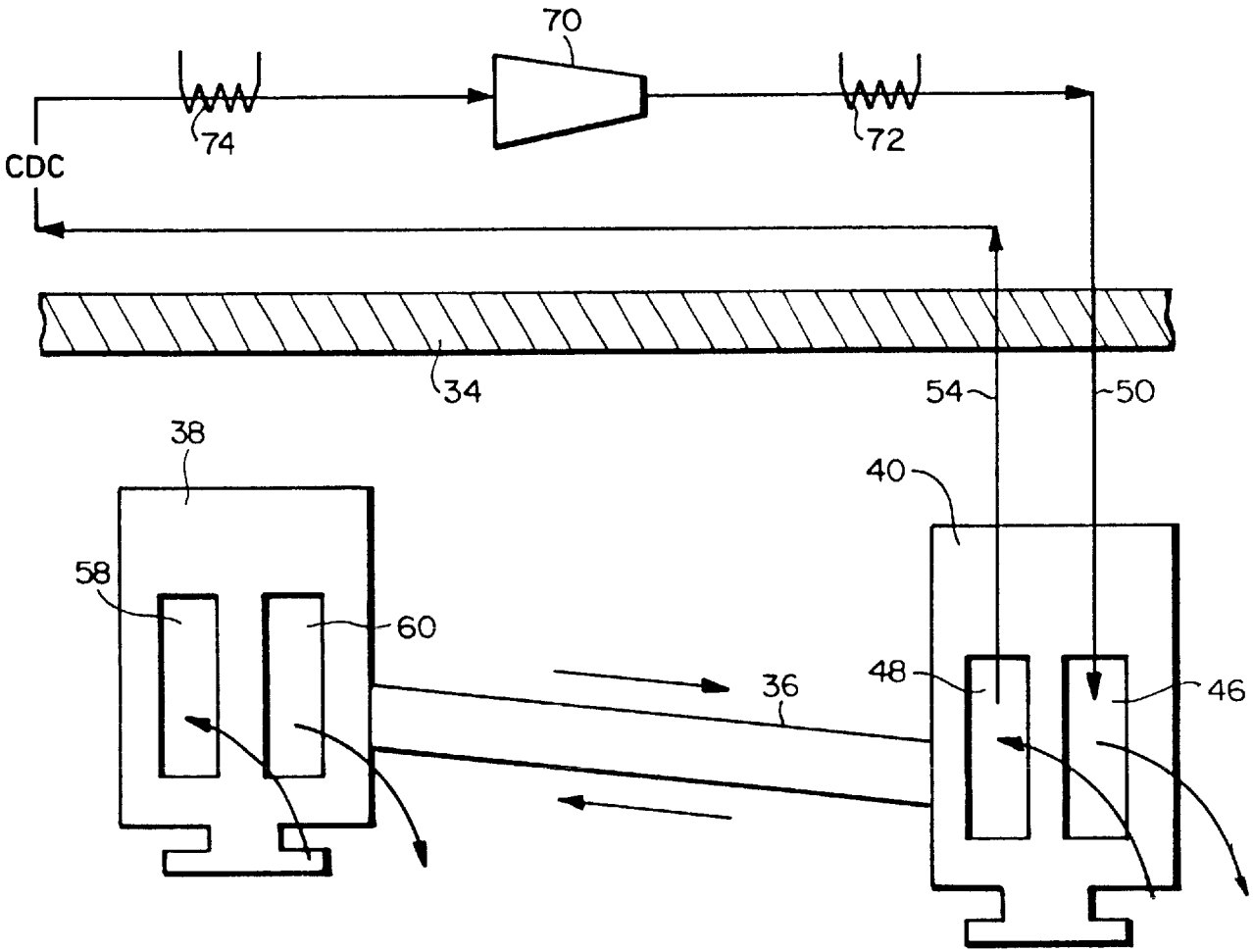
FIG. 4 is a schematic diagram illustrating the flow circuit for flowing a thermal medium from an external source to and from the inner shell.

The first passage portion 46 of the aft inner shell section 40 communicates with a pair of first passageways 56 extending along the split line of the inner shell half axially forwardly for communication with a first passage portion 58 of the forward inner shell section 38. The first passage portion 58 of the forward section 38 extends circumferentially from the mid-line passages 56 to intermediate locations in communication with second passage portions 60 of the forward section 38 via crossover paths 62 and 64 (FIG. 4). The second passage portions 60 of the forward section 38 extend from crossover paths 62 and 64 to the mid-line of the inner shell half to lie in communication with axially rearwardly extending second passageways 68, in turn in communication with the second passage portions 48 of the aft section 40. As will be recalled, the second passage portions 48 lie in communication with the outlet 54.

Referring now to FIG. 3, there is illustrated an external or off-turbine device for supplying cooling or heating air to the inner shell, depending upon the operating conditions of the turbine. For example, there may be provided on an off-turbine skid, and a compressor 70 with associated heat exchangers 72 and 74 for selectively cooling and heating the air. Thus, for example, during turbine startup, heated air may be supplied from the heater 72 to the inlet 50 for circulation of heated air in the various passages of the inner shell halves to radially expand the inner shell and hence displace the shrouds radially further outwardly than the tips of the buckets. It will be appreciated that the inner shell thus heats up at a greater rate than the rotor to ensure that adequate clearance is maintained between the shrouds and the bucket tips during startup. In steady-state operations, the temperature of the air supplied the inner shell can be adjusted to contract or expand the inner shell relative to the bucket tips thereby to afford a minimum clearance between the shrouds and bucket tips and enhance the efficiency of the turbine operation. During turbine shutdown, it is important to maintain the rate of contraction of the inner shell less than the rate of contraction of the rotor and buckets to avoid contact between the turbine tips and the shrouds. To that end, the temperature of the thermal medium can be adjusted so that a controlled tip clearance during shutdown is maintained.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of operating a turbine having a rotor including axially spaced buckets carried thereby forming parts of turbine stages, an outer containment shell, an inner shell about the rotor including nozzles carried thereby forming other parts of said turbine stages and shrouds about the respective tips of said buckets of said stages, and a passage formed in said inner shell for flow of a thermal medium to control thermal movement of said inner shell, comprising the steps of:

flowing the thermal medium serially (i) through passage portions of the inner shell at a first axial location corresponding in part to an axial location of a second stage of said turbine, (ii) forwardly along said inner shell from said first axial location to passage portions of said inner shell at a second location corresponding in part to an axial location of a first stage of the turbine and (iii) rearwardly along said inner shell from said second axial location to passage portions of said inner shell at said first axial locations to control the thermal radial expansion and contraction of said inner shell and the clearance between the tips of the buckets and shrouds of each said first and second stages.

2. A method according to claim 1 wherein said inner shell includes a pair of inner shell halves defining a mid-line between said halves, providing an inlet for the thermal medium to said passage portions at said first axial location, splitting the flow of thermal medium from said inlet along arcuate passage portions along said inner shell at said first axial location, flowing the thermal medium from said arcuate flow portions along first plural passageways, respectively, to said second axial location and returning the thermal medium from said passage portions at said second axial location along second plural passageway portions to said passage portions at said first axial location and providing an outlet for receiving the thermal medium from said passage portions at said first axial location for flow outwardly of said inner shell.

3. A method of operating a turbine having a rotor including axially spaced buckets carried thereby forming parts of turbine stages, an outer containment shell, an inner shell about the rotor including nozzles carried thereby forming other parts of said turbine stages, said inner shell including axially spaced sections and shrouds carried by said sections about the respective tips of said buckets of said stages, and a passage formed in said inner shell for flow of a thermal medium to control thermal movement of said inner shell, comprising the steps of:

forming at least partially circumferentially extending first portions of said passage in said sections of said inner shell substantially at each axial location of the buckets of the respective stages;

providing a first passageway in said inner shell connecting the first passage portions to one another;

flowing the thermal medium through (i) a first passage portion of one section, (ii) said first passageway and (iii) a first passage portion of another section;

forming at least partially circumferentially extending second portions of said passage in said sections of said inner shell substantially at each axial location of the buckets of the respective stages;

providing a second passageway in said inner shell connecting the second passage portions to one another;

connecting the first passage portion of said another section with a second passage portion of said another section for flowing the thermal medium therebetween; and flowing the thermal medium through (i) said second passage portion of said another section, (ii) said second passageway and (iii) a second passage portion of said one section;

thereby controlling the thermal radial expansion and contraction of said inner shell and the clearance between the tips of the buckets and shrouds of each stage.

4. A method according to claim 3 wherein said one section lies at an axial location corresponding to a second stage of the turbine and said another section lies at an axial location corresponding to a first stage of the turbine, and flowing the thermal medium serially from said second section to said first section and back to said second section.

5. A method according to claim 3 including connecting said inner shell and said outer shell to one another to preclude radial and circumferential movement of said inner shell relative to said outer shell and enable thermal radial expansion and contraction of said inner shell relative to said outer shell.

6. A method according to claim 3 including operating the turbine in a steady-state condition, and controlling the temperature of the thermal medium during the steady-state operating condition to control the clearance between the bucket tips and the shrouds.

7. A method according to claim 3 including providing a thermal medium source independent of said turbine operation for controlling the temperature of the thermal medium.

8. A method according to claim 7 including providing a closed circuit for supplying the thermal medium between the source and the passage.

9. A method according to claim 3 including during shutdown of the turbine, controlling the temperature of the thermal medium to preclude a rate of contraction of the inner shell less than the rate of contraction of the rotor and buckets to avoid contact between the turbine tips and the shrouds.

10. A method according to claim 3 including during turbine startup, controlling the temperature of the thermal medium to thermally expand the inner shell at a rate at least equal to or greater than the thermal expansion rate of the rotor and buckets to prevent contact between the turbine tips and the shrouds.

11. A method according to claim 3 including providing an inlet in communication with said passage and connected between said inner and outer shells for receiving the thermal medium from a source external to said turbine, and providing an outlet in communication with said passage and connected between said inner and outer shells for exhausting the thermal medium from the turbine.

12. A method according to claim 3 wherein said inner shell includes a pair of inner shell halves defining a mid-line between said halves, said passage being disposed in one of said inner shell halves, providing said first passage portion of said one section about said one inner shell half substantially to said mid-line thereof, providing a pair of first passageway portions of said first passageway generally axially along said mid-line, said first passage portion of said another section forming a pair of paths extending generally from the mid-line of said inner shell half in communication with said pair of first passageway portions, respectively, for flowing the thermal medium substantially about the inner shell half, providing communication between said pair of first passage portion paths and a pair of second passage portions of said passage in said another section, providing a pair of second passageway portions of said second passageway generally extending along said mid-line of said inner shell half and in communication with said second passage portions of said another section and said second passage portions of said one section, providing a thermal medium inlet to said first passage portions of said one section and providing a thermal medium outlet for said second passage portions of said one section whereby said passage forms a closed circuit within said inner shell half.

* * * * *

UNITED STATES PATENT AND TRADEMARK OFFICE

CERTIFICATE OF CORRECTION

PATENT NO. : 6,422,807 B1
APPLICATION NO. : 09/726213
DATED : July 23, 2002
INVENTOR(S) : Leach et al.

It is certified that error appears in the above-identified patent and that said Letters Patent is hereby corrected as shown below:

In Column 1, immediately below the title, insert:

--The Government of the United States of America has rights in this invention pursuant to Contract No. DE-FC21-95MC31176 awarded by the U. S. Department of Energy.--

Signed and Sealed this

Twentieth Day of February, 2007

JON W. DUDAS
*Director of the United States Patent and Trademark Office*